4,524,279

United States Patent [19]

Christianson et al.

[11] Patent Number: 4,524,279

[45] Date of Patent: Jun. 18, 1985

[54] RADIATION SOURCE SHIELD AND CALIBRATOR

[75] Inventors: Charles L. Christianson, Laurel; Richard Spurlock, Wheaton, both of Md.

[73] Assignee: The United States of America as represented by the Secretary of the Navy, Washington, D.C.

[21] Appl. No.: 467,727

[22] Filed: Feb. 18, 1983

[51] Int. Cl.[3] ..... G21F 5/02

[52] U.S. Cl. ..... 250/497.1; 250/252.1; 250/506.1; 250/522.1

[58] Field of Search ..... 250/252.1, 497.1, 506.1, 250/522.1

[56] References Cited

PUBLICATIONS

Chase et al., *Principles of Radioisotope Methodology*, 3rd ed., 1967, pp. 260–261.

*Primary Examiner*—Alfred E. Smith
*Assistant Examiner*—Jack I. Berman
*Attorney, Agent, or Firm*—Robert F. Beers; Donald J. Breh; John G. Wynn

[57] ABSTRACT

A device for shielding a radiation source that is adapted to selectively position the source to be stored and shipped or positioned for repetitively establishing a radiation field for calibrating radiation detection devices.

8 Claims, 4 Drawing Figures

RADIATION SOURCE SHIELD AND CALIBRATOR

BACKGROUND OF THE INVENTION

This invention relates to radiation shielding devices. More particularly, the invention relates to a radiation shielding device adapted to function as a shipping and storage container and as a radiation calibration source.

When calibrating radiation measuring devices such as radiation survey meters or dosimeters, it is common to establish a known radiation field with a radiation source and place the device to be calibrated within the field. Heretofore, it has been necessary to perform the calibration at large centralized facilities having rooms equipped with appropriate radiation sources and equipment for establishing the known field. It is highly desirable to be able to calibrate these measuring devices at the location where they are to be used, and, thus, eliminate the necessity for the large centralized facilities. To do so requires the ability to establish the known radiation field repeatably at the desired location. Additionally, there is always the problem of storing and shipping the radiation source so as to shield personnel from dangerous radiation.

Normally, radiation sources are stored in lead bricks, lead containers, or behind lead shields. While these devices are normally effective in shielding personnel from radiation they are bulky, heavy, and difficult to handle rendering them generally undesirable as shipping containers. More importantly, as far as can be determined, no shielding container has been devised having means for holding the radiation source in an exposed mode for establishing a known radiation field like the present invention. Rather, in the prior art, the source is removed from the container and used merely to give an indication that the measuring device is operating. Thus, a known radiation field is not established. Consequently, there is a need in the prior art to configure a storage and shipping container that is also adapted to mount the radiation source in a known position, when removed therefrom, for establishing a repeatable known radiation field for calibrating associated radiation measuring devices.

SUMMARY OF THE INVENTION

Accordingly, an object of the invention is configured to a storage container for storing a radiation source so as to reduce the radiation emitted by the radiation source to levels safe for personnel in an improved manner.

Another object of the invention is to configure the storage container to be compact, lightweight, and capable of also functioning as an easily handled shipping container for the radiation source in an improved manner.

A further object of the invention is to configure the storage container so that a portion thereof is easily converted to a stand for holding the radiation source in a predetermined position for repetitively establishing at different times and locations a known radiation field for calibrating associated radiation measuring devices.

The foregoing objects are achieved and the shortcomings of the prior art overcome by configuring the storage container to comprise a lightweight case having an internal lead member attached thereto for receiving and shielding the radiation source when it is being stored or shipped. The case further includes a top portion for attaching the radiation source external thereto in a predetermined position for repetitively establishing the geometric relationship necessary to produce a known radiation field.

DETAILED DESCRIPTION OF THE PREFERRED EMBODIMENT

Figure 1:
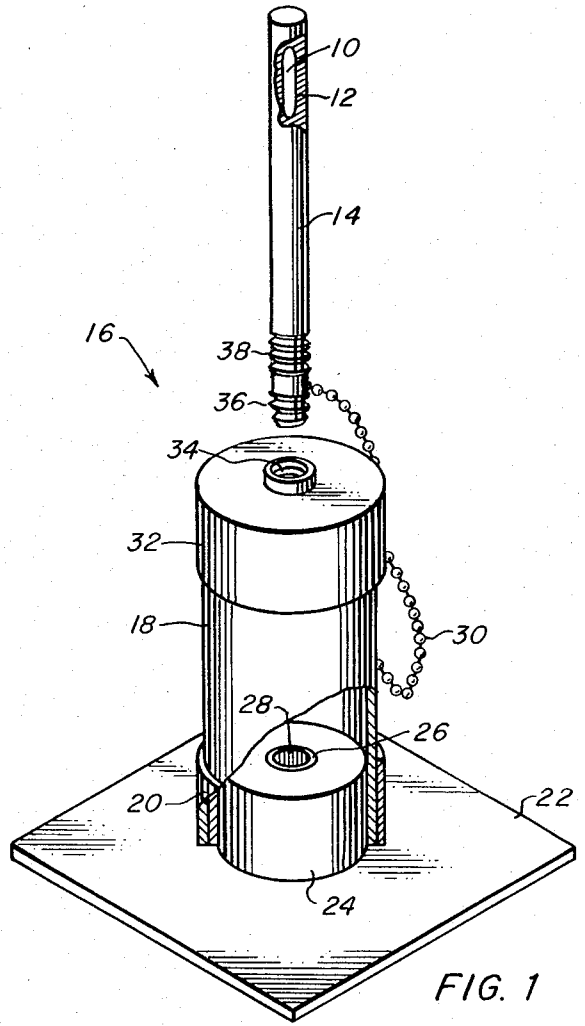
FIG. 1 is an exploded view of the preferred embodiment with part of the case cut away showing details of construction and assembly.

Referring to FIG. 1, the preferred embodiment described hereinbelow has been designed to accommodate a low level radiation source 10 of Krypton-85 gas. The radiation source 10 source is contained in an ampule 12 embedded in a rod 14 and has a strength of 5 millicuries and a radiation intensity of 5 milliroentgens per hour as measured at the bare surface of rod 14 adjacent the ampule 12. When shielded by the container of the present invention, the radiation intensity level is reduced to less than 0.5 milliroentgen as measured at the surface of the container. This level of intensity is considered acceptable for shipping between locations and handling by personnel. It is to be understood that the invention is equally applicable to other radiation sources.

Figure 2:
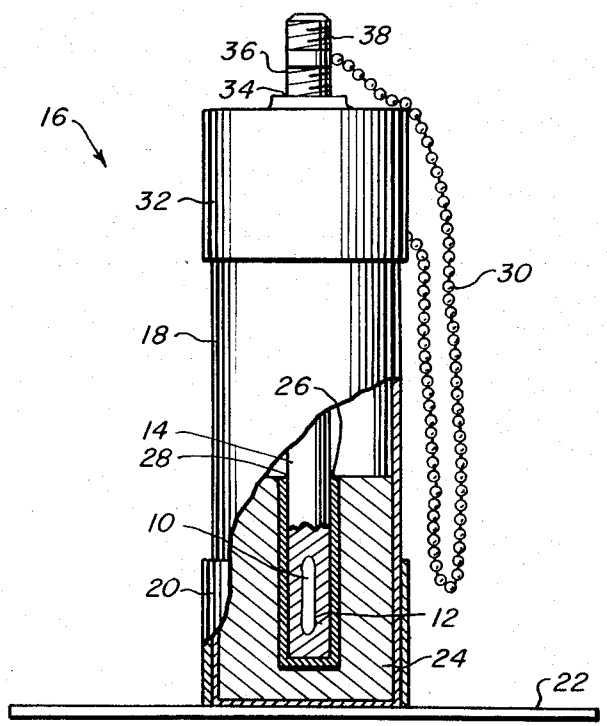
FIG. 2 is an assembly drawing of the preferred embodiment in partial cut away section showing the radiation source in the shielded position for storage and shipping.

Shown in FIGS. 1 and 2 is a radiation source shield and calibration device 16. The device includes tubular case 18 closed on one end by first closure member 20. A base plate 22 is affixed to member 20 to allow the device to stand vertically. Alternatively, base plate 22 could also function as the closure for case 18 and could be an integral part of case 18.

A lead internal member 24 for absorbing radiation from the source is fitted within the case and extends along the case a distant sufficient to absorb the radiation. Internal member 24 includes a cavity for receiving a liner 26 for forming a receptacle 28 to receive the radiation source 10. Receptacle 28 is disposed coaxially with liner 26 and case 18. Rod 14 slides into receptacle 28 to place the radiation 10 within the lead internal member 24. Rod 14 is kept from being separated from the device by a chain 30.

Still referring to FIGS. 1 and 2, case 18 is closed on its opposite end with a second closure member 32. The second closure member 32 includes an aperture 34 disposed co-axially therein and with case 18 and receptacle 28 when second closure member 32 is attached thereto. The aperture 34 is configured to threadedly receive first and second threaded portions 36 and 38, respectively, of 36 on rod 14. In the stored position, shown in FIG. 2, the road 14 is inserted through aperture 34 into receptable 28 thus shielding the radiation source 10. Threaded portion 36 secures the rod and the radiation source 10 therein. In the stored configuration, the radiation source 10 is shielded and the entire device is easily handled for storing or shipping. The preferred materials for case 18, closure members 20, 32 and base plate 22 are those that are lightweight, readily available, and easy to fabricate such as copper or plastic. Recepticle 28 is preferably copper.

Figure 3:
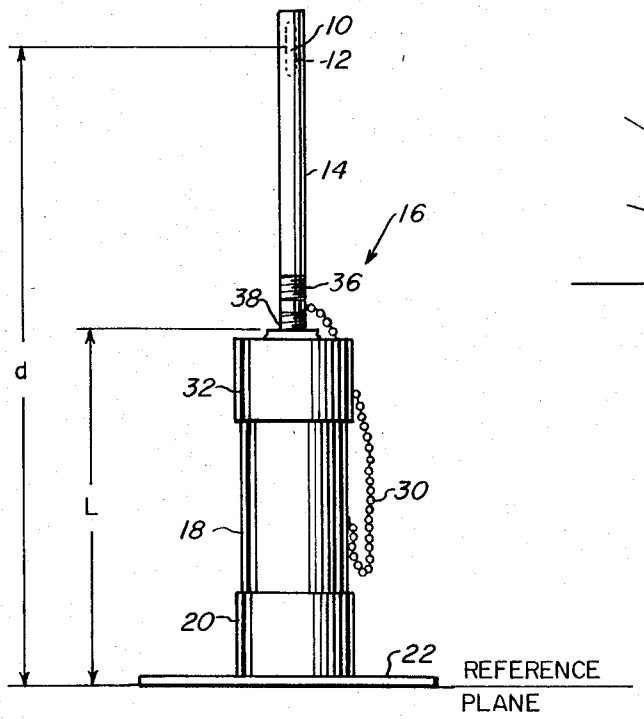
FIG. 3 is an assembly drawing of the preferred embodiment showing the radiation source positioned on the case at a predetermined location.

Alternatively, the radiation source 10 may be mounted in the exposed calibration configuration, shown in FIG. 3. When this position is selected, rod 14 is removed from case 18 and turned end for end. The second threaded portion 38 thereon engages aperture 34 thereby holding the rod 14 and the radiation source 10 in a vertical position.

Figure 4:
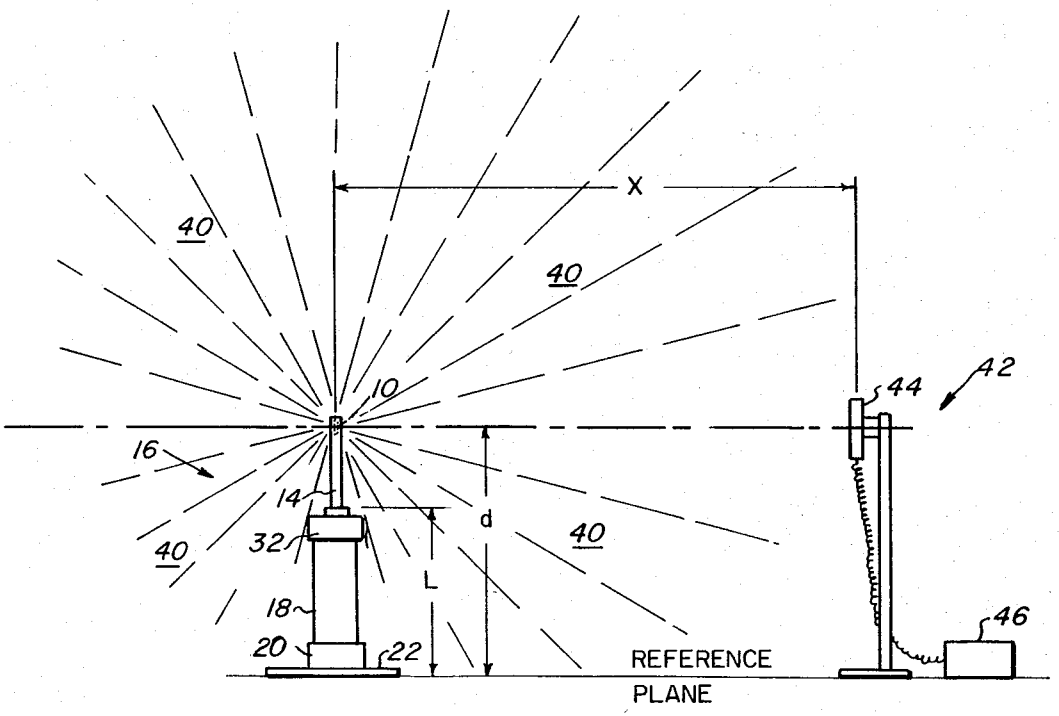
FIG. 4 is a diagrammatic representation of the preferred embodiment in use creating a radiation field for calibrating a radiation measuring device.

In order to repetitively establish at different times and locations the geometric relationship of a known radiation field 40, as shown in FIG. 4, the radiation source 10 must be repetitively positioned at the same known distance d in relation to a reference plane, see FIGS. 3 and 4. The reference plane is herein defined to be the surface upon which the base plate 22 is resting. Therefore, case 18 is manufactured to a predetermined length L for a particular length of the rod 14 and the radiation source 10 used, thereby positioning the the radiation source 10 at a known position relative to the reference plane each time the calibration device 16 is used to calibrate a measuring device 42 (see FIG. 4). Knowing the radioactivity level and position of the radiation source 10, the geometry of the field of radiation established is capable of being repeated at different times and at different sites.

As shown in FIG. 4, when calibrating measuring device 42, calibration device 16 is placed on the reference plane to establish the predetermined radiation field geometry. The center of a measuring device sensor 44 is positioned at the same predetermined distance d about the reference plane as the radiation source 10. Further, measuring device sensor 44 is positioned at the same predetermined horizontal distance x from the radiation source 10 as in prior calibrations. With the measuring device sensor 44 so placed, an indicator 46 is adjusted to indicate the radiation field intensity at that position.

It should be appreciated that subsequent calibrations can be made merely by placing measuring device sensor 44 at the same predetermined distances d and x. The radiation intensity does not change between calibrations because the geometry of the radiation field is held constant by calibration device 16.

To those skilled in the art, modifications and variations of the present invention are possible in light of the above teachings. It is therefore to be understood that the present invention can be practiced otherwise than as specifically described herein and still be within the spirit and scope of the appended claims.

What is claimed is:

1. An apparatus adapted to function as a shipping and/or storage container and as a calibration device for a predetermined radiation source associated therewith, comprising:

a case;

first means affixed to one end of said case so as to allow said case to stand vertically and to close the one end thereof;

second means affixed to the other end of said case opposite to said first means so as to allow the predetermined radiation source to be secured to said second means, and so as to close the other end of said case;

shielding means for absorbing radiation from the predetermined radiation source, said shielding means being fitted within said case at the one end thereof; and storing and calibrating means including a rod having an ampule containing the predetermined radiation source embedded in one end thereof, and said rod being configured on the other end thereof so as to be insertable into said case via said second means to place the predetermined radiation source within said shielding means for carrying out of the shipping and/or storage function, and said rod being additionally configured on the same other end thereof so as to be attachable to said second means to place the predetermined radiation source a predetermined distance above said first means for carrying out of the calibration function.

2. The apparatus of claim 1 wherein said case is tubular.

3. The apparatus of claim 2 wherein said first means comprises:

a first closure member configured to cap the one end of said case closed and be permanently affixed thereto; and a base plate affixed to said first closure member and being configure to stabilize said case to stand vertically.

4. The apparatus of claim 3 wherein said second means includes a threaded aperture coaxially configured therein.

5. The apparatus of claim 4 wherein said shielding means includes a receptacle configured coaxially therein in alignment with said threaded aperture for receiving the other end of said rod containing the predetermined radiation source.

6. The apparatus of claim 5 wherein said rod includes on the other end thereof a first threaded portion for threadedly inserting the one end of said rod, containing the predetermined radiation source, via said threaded aperture of said second means, into said receptacle of said shielding means.

7. The apparatus of claim 6 wherein said rod further includes on the other end thereof a second threaded portion for threadedly attaching said rod to said second means so that the other end of said rod, containing the predetermined radiation source and the radiation source, is placed the predetermined distance as measured from the bottom of said base plate of said first means.

8. The apparatus of claim 7 further including a chain connected between said case and said rod of said storaging and calibrating means so as to keep them from being separated.

* * * * *